United States Patent [19]

Winyard

[11] Patent Number: 4,594,831

[45] Date of Patent: Jun. 17, 1986

[54] STEEL DOOR FRAME WITH THERMAL BREAK

[75] Inventor: Rodney W. Winyard, Warren, Ohio

[73] Assignee: American Welding & Manufacturing Co., Warren, Ohio

[21] Appl. No.: 705,142

[22] Filed: Feb. 25, 1985

[51] Int. Cl.[4] ..... E04B 1/64; E06B 1/32

[52] U.S. Cl. ..... 52/395; 49/DIG. 1; 52/212; 52/403

[58] Field of Search ..... 52/395, 398, 403, 212, 52/213; 49/DIG. 1, 505

[56] References Cited

U.S. PATENT DOCUMENTS

| | | | |
|---|---|---|---|
| 2,659,463 | 11/1953 | Persson | 52/398 |
| 2,742,117 | 4/1956 | Tolman | 49/399 |
| 2,860,744 | 11/1958 | Mascari | 52/212 |
| 2,912,725 | 11/1959 | Ries . | |
| 3,114,179 | 12/1963 | Briggs | 52/403 |
| 3,191,727 | 6/1965 | Schmeltz et al. | 52/403 |
| 3,203,053 | 8/1965 | Lane et al. | 52/212 |
| 3,403,490 | 10/1968 | Luedtke | 49/DIG. 1 |
| 3,925,953 | 12/1975 | LaBorde | 52/403 X |
| 4,079,496 | 3/1978 | Schmidt | 49/DIG. 1 |

FOREIGN PATENT DOCUMENTS

| | | | |
|---|---|---|---|
| 2618090 | 11/1977 | Fed. Rep. of Germany | 49/DIG. 1 |
| 2617518 | 11/1977 | Fed. Rep. of Germany | 49/DIG. 1 |

*Primary Examiner*—J. Karl Bell

*Attorney, Agent, or Firm*—Watts, Hoffmann, Fisher & Heinke Co.

[57] ABSTRACT

A steel door frame with thermal break characterized by a complete separation of exterior and interior components.

7 Claims, 3 Drawing Figures

STEEL DOOR FRAME WITH THERMAL BREAK

DESCRIPTION

1. Technical Field

This invention relates generally to metal frame structures and, more particularly, to a new and improved steel door frame construction having a complete thermal break.

2. Disclosure of Invention

The present invention provides for a framing structure having two framing components and a rigid connector of low thermal conductivity to serve as a thermal break. The thermal break attaches the two components of the framing structure to each other without fasteners. Since the thermal break replaces conventional fasteners, there is no metal to metal linkage between the components as occurs in conventional frames connected by screws, rivets, and such. The metal to metal linkage in conventional frames allows cold to be conducted from the outside to the interior along the linkage, with the result that ice can form on the interior side of the frame. The thermal break establishes complete separation of the two components so that the component exposed to outdoor temperatures is never in contact with the component in the interior of the building. The complete separation of the metal components provides for a novel, well-insulated framing structure.

The thermal break is symmetrical in cross-section so that it engages the framing components from either side. The symmetrical cross-section of the thermal break also allows it to be used with either hand of the framing structure, obviating the need for right and left handed connectors and simplifying inventory control. The symmetry of the thermal break allows the same framing structure to accommodate either a left-hand or right-hand swing opening without any adaptations to the structures.

Slots are provided in the thermal break so that a weather-proofing strip can be attached. Although it is possible to fabricate a one-piece rigid thermal break having a flexible weather-proofing strip, the slots allow for replacement of weather-proofing strips as they wear out or are damaged in use.

The unique shape of the framing components and the thermal break allow for the framing structure to incorporate regular wall anchors, such as masonry, wood stud, and steel stud anchors, so that the framing structure can be installed in a building as either a wrap-around frame or a butted frame.

An object of the invention is to provide a new steel door frame which is characterized by an improved thermal break.

Another object of the invention is to provide a new two-piece steel door frame characterized by a thermal break which holds the pieces together without any fasteners.

A further object of the invention is to provide a symmetrical thermal break which can be used in right or left hand door frames.

Yet another object of the invention is to provide a new thermal break door frame construction which permits the use of conventional, unmodified anchors, such as masonry, wood stud and steel stud anchors.

Still another object of the invention is to provide a new thermal break door frame as described above which is additionally characterized by the incorporation of replaceable, flexible weatherstripping.

More particularly, the invention provides a thermal break frame suitable for framing a wall opening such as a door. The frame comprises a pair of metal members each having an edge flange along one side. The metal members are connected by a one-piece plastic thermal break element adapted to be positioned between and to lockingly engage the edge flanges. The thermal break element has spaced channels which are adapted to receive the edge flanges of the metal members and to maintain the metal members in a spaced relation.

The following detailed description taken in conjunction with the accompanying drawings will lead to a better understanding of the invention.

BEST MODE FOR CARRYING OUT THE INVENTION

Figure 1:
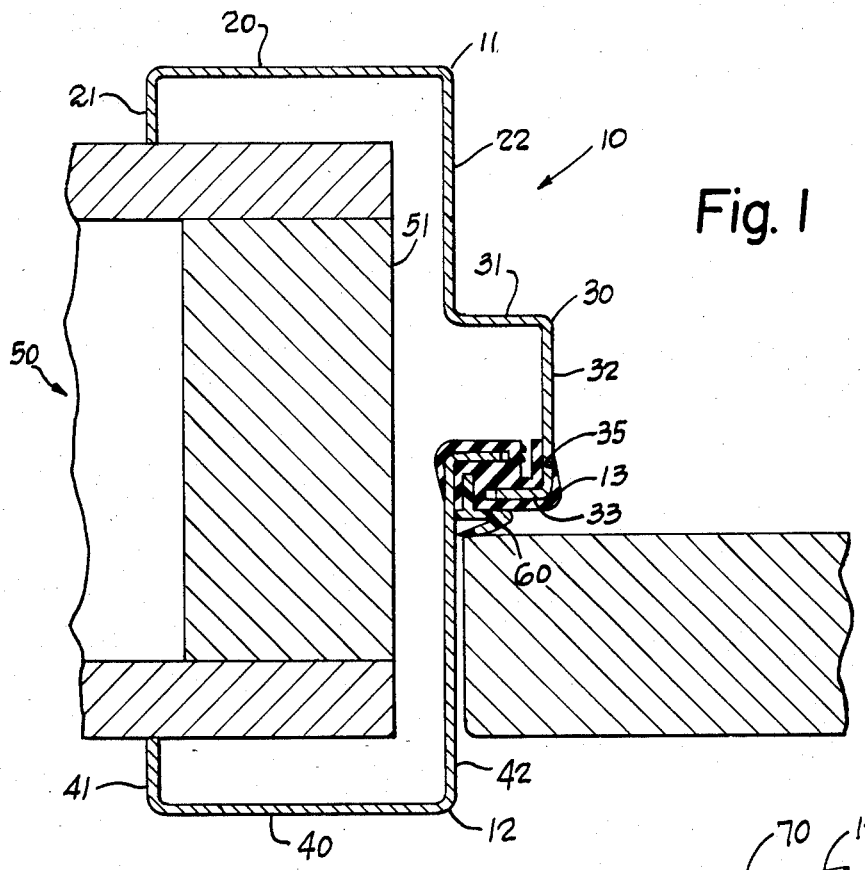
FIG. 1 is a horizontal cross-sectional view of a door frame constructed in accordance with the present invention.

Referring now to the drawings, the framing structure 10 is depicted for purposes of illustration, as a double rabbet, wrap-around door frame attached to building member 50. The framing structure 10 comprises an inside framing member 11 engaged to an outside framing member 12 by a thermal break 13.

The inside framing member 11 includes a face 20, a wall backbend 21 integral with and extending at a right angle from one edge of the face 20, and a rabbet 22 integral with and extending at a right angle from the other edge of the face 20. The rabbet 22 extends along the surface of the opening 51 formed in the building member 50.

A stop-forming portion 30, extends from the rabbet 22 and includes an outwardly extending leg 31, a soffit 32, and an inwardly extending locking leg 33.

The outside framing member 12 includes a face 40, a wall backbend 41 extending at a right angle from one edge of the face 40, and a rabbet 42 extending at a right angle from the other edge of the face 40. The rabbet 42 extends about the edge of the opening 51 formed in the building member 50 and toward the rabbet 22 in a common plane therewith.

An outwardly projecting locking leg 34 extends at a right angle from the panel 42 and projects substantially parallel to the inwardly extending locking leg 33.

Figure 2:
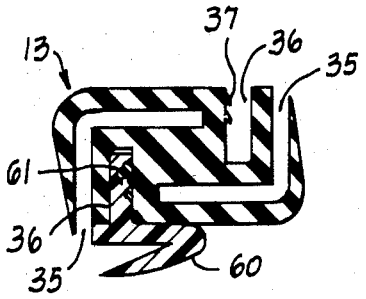
FIG. 2 is a horizontal cross-sectional view of a thermal break element.

As shown in FIG. 2, the thermal break 13, which engages framing members 11 and 12, has a pair of longitudinally extending, oppositely facing L-shaped channels 35 adapted to receive the locking legs 33, 34 to hold the framing members 11 and 12 together.

The thermal break 13 further includes a second pair of longitudinally extending, oppositely facing channels 36 to selectively receive a weather-proofing strip 60. The channels 36 have at least one serration 37 to mesh with a complementary serration 61 on weather-proofing strip 60. The thermal break 13 is preferably of rigid, low-thermoconductive material, such as vinyl or the like. The weather-proofing strip 60 is preferably of a flexible low-thermoconductive material.

Figure 3:
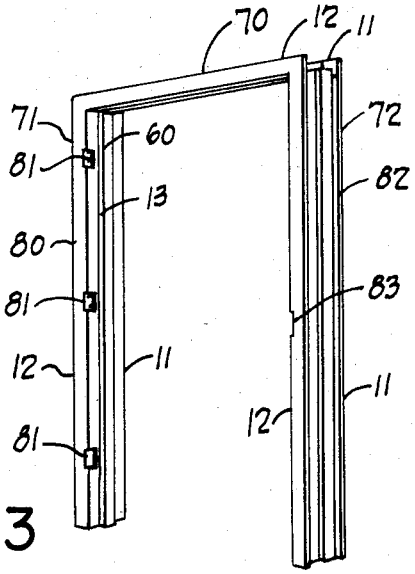
FIG. 3 is a perspective view on a reduced scale of the assembled framing structure.

By way of example, the assembly of a complete door frame as shown in FIG. 3, is carried out by forming a header 70 and two jamb sections 71, 72. The proper lengths of inside and outside framing members 11, 12 are joined together with a corresponding length of thermal break 13 by sliding the locking legs 33, 34 into the L-shaped channels 35 of the thermal break 13. The jamb and header sections can be joined together to form a door frame by any suitable method. For instance, the opposite ends of the header sections can be formed into tabs which fit into slots provided in the upper ends of the jamb sections, or the upper ends of the jamb sections and the opposite ends of the header section can be mitered, abutted and joined by welding or the like. The hinge jamb 80 is provided with hinges 81, and the strike jamb 82 is provided with a strike plate 83. The flexible weatherstripping 60 is inserted in one of the channels 36 of the thermal break 13.

The described door frame provides a frame characterized by a complete separation between the outside and inside frames. The complete separation is achieved by a thermal break which fastens the outside and inside frames to each other without metal connectors. One advantage of the door frame is that the complete separation prevents cold from being conducted from the outside to the inside along a metal to metal linkage. Another advantage of the door frame is that the thermal break is symmetrical so that it can be used in rigid or left hand door frames and can incorporate replaceable, flexible weatherstripping.

Many variations and modifications of the invention will be apparent to those skilled in the art from the above detailed disclosure. Therefore, it is to be understood that, within the scope of the appended claims, the invention can be practiced otherwise than as specifically shown and described.

I claim:

1. A thermal break frame suitable for framing a wall opening comprising a pair of metal members each having an edge flange along one side, and a one-piece plastic thermal break element adapted to be positioned between and to lockingly engage said edge flanges, thereby connecting said metal members together, said thermal break element having spaced apart, longitudinally extending, oppositely facing, L-shaped channels adapted to receive said edge flanges and to maintain them in spaced relation.

2. A thermal break frame as claimed in claim 1 wherein said thermal break element is symmetrical in shape, whereby it can be used to assemble right and left hand frames.

3. A thermal break frame suitable for framing a wall opening comprising a pair of metal members each having an edge flange along one side, a one-piece plastic thermal break element adapted to be positioned between and to lockingly engage said edge flanges, thereby connecting said metal members together, said thermal break element having spaced channels adapted to receive said edge flanges and to maintain them in spaced relation, said thermal break element further having means for engaging and supporting flexible weatherstripping.

4. A thermal break frame suitable for framing a wall opening comprising a pair of metal members each having an edge flange along one side, a one-piece plastic thermal break element adapted to be positioned between and to lockingly engage said edge flanges, thereby connecting said metal members together, said thermal breaking element having spaced channels adapted to receive said edge flanges and to maintain them in spaced relation, said thermal break element further having a slot adjacent at least one of said channels, and a replaceable flexible weatherstripping element adapted to be inserted into said slot.

5. A thermal break door frame assembly comprising a first metal member which defines a soffet and has a stop forming flange along one side of said soffet, a second metal member which defines a rabbet and has an edge flange at right angles to said rabbet, and a one-piece plastic thermal break element having spaced apart, longitudinally extending, oppositely facing L-shaped channels adapted to receive said flanges to hold said metal members together, said channels including a first channel for receiving said stop-forming flange and part of said soffet and a second channel for receiving said edge flange and a portion of said rabbet, said thermal break element being effective to maintain said flanges in spaced relation.

6. A thermal break door frame assembly as claimed in claim 5 wherein said thermal break element is symmetrical in cross-section and includes a pair of slots for selectively receiving replaceable weatherstripping.

7. A thermal break door frame assembly as claimed in claim 5 wherein said thermal break element includes a longitudinally extending slot between said channels for receiving weatherstripping means.

* * * * *